United States Patent [19]

Driscoll

[11] 4,270,462

[45] Jun. 2, 1981

[54] TABLE EASEL

[76] Inventor: Michael J. Driscoll, P.O. Box 989, Willits, Calif. 95490

[21] Appl. No.: 6,565

[22] Filed: Jan. 26, 1979

[51] Int. Cl.[3] ..... A47B 41/04

[52] U.S. Cl. ..... 108/32; 248/448

[58] Field of Search ..... 248/441 B, 448, 449, 248/460, 464

[56] References Cited

U.S. PATENT DOCUMENTS

| | | | |
|---|---|---|---|
| 97,481 | 12/1869 | Cowgill | 108/32 |
| 490,569 | 1/1893 | Lehman | 248/441 B X |
| 1,334,264 | 3/1920 | Sheean | 108/32 |
| 1,990,103 | 2/1935 | Van Alstyne | 248/448 X |
| 2,912,203 | 11/1959 | Townsend | 248/448 |
| 3,226,077 | 12/1965 | Killen | 248/448 |
| 3,416,764 | 12/1968 | Bier | 248/441 B X |
| 3,926,398 | 12/1975 | Vincent | 248/448 |
| 4,109,892 | 8/1978 | Hartung | 248/449 |
| 4,134,614 | 1/1979 | Fielding, Sr. | 248/448 |

*Primary Examiner*—Roy D. Frazier
*Assistant Examiner*—Peter A. Aschenbrenner
*Attorney, Agent, or Firm*—David B. Harrison

[57] ABSTRACT

A table easel construction. A frame for holding and positioning a workpiece of various sizes and shapes is attached at its base to a table surface which is mounted on a base. The holding and positioning frame includes at least one vertical support attached to the rear edge of the table surface and to the upper end of the rest of the frame. The base of the holding and positioning frame may be fastened to the table surface at various positions thus enabling the angle of the workpiece relative to the table surface to be adjusted. Upper and lower clamps on the holding and positioning frame hold the workpiece above the table surface and are independently adjustable upwardly and downwardly on the frame thereby enabling the distance of the workpiece above the table to be varied and also enabling the distance between upper and lower clamps to be increased or decreased.

1 Claim, 4 Drawing Figures

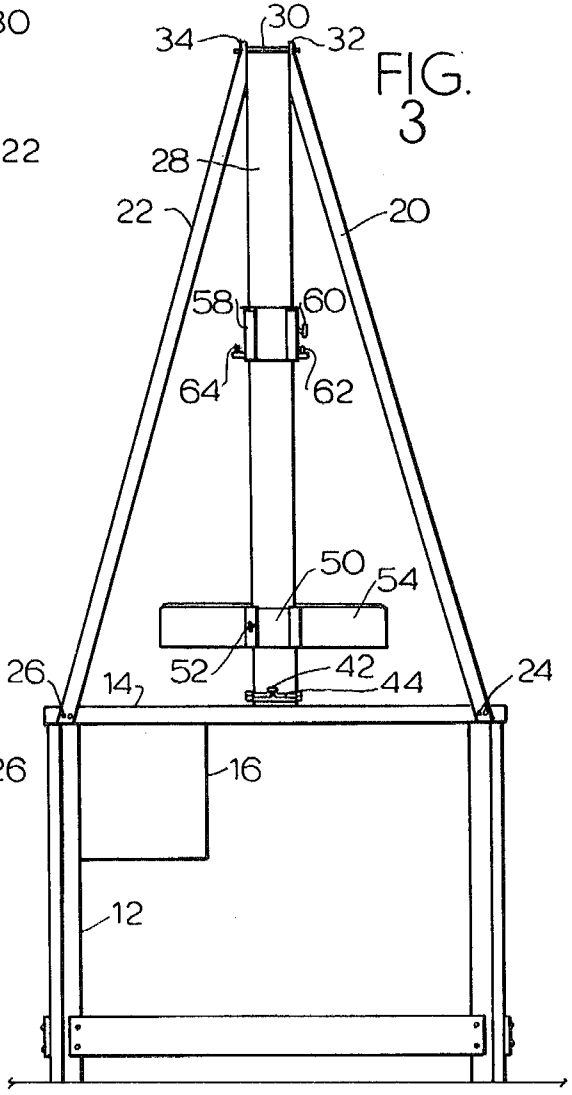
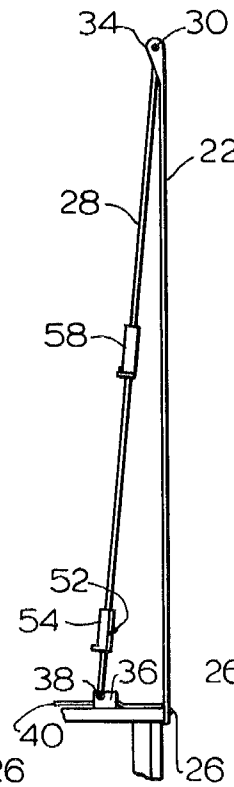
FIG. 4
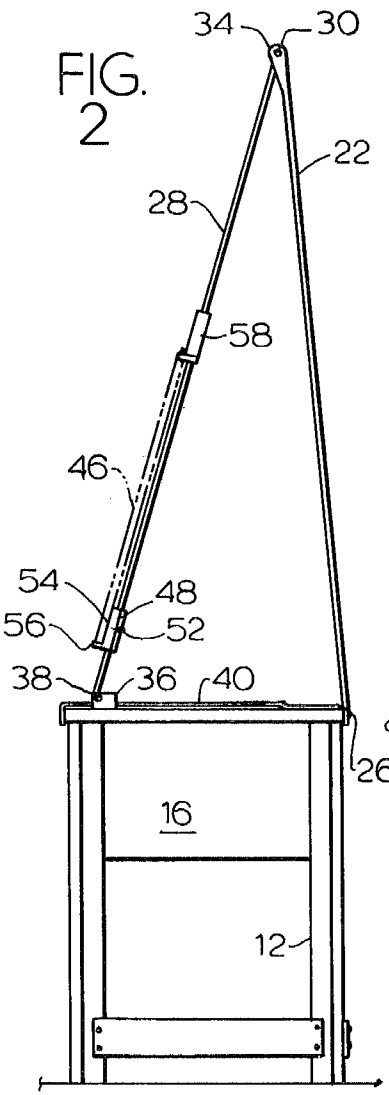
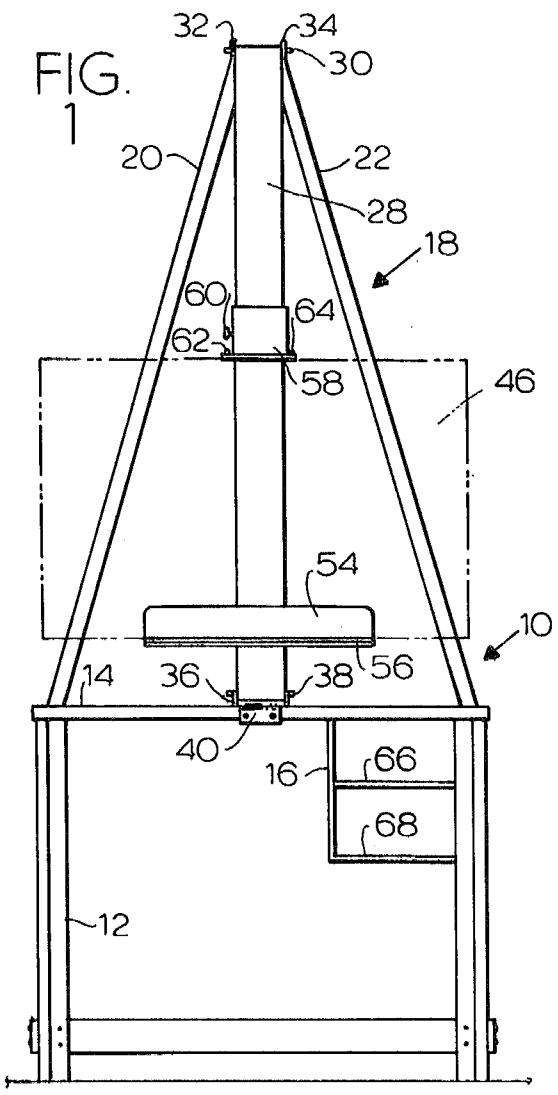

TABLE EASEL

BACKGROUND OF THE INVENTION

The present invention relates to easel construction, and more particularly to table easel construction.

Free standing easels and easels which are placed and rest on tops of desks or tables have been in use for many years to support books, charts, tables, and work surfaces on which drawings, paintings, collages and other artworks are executed.

One common easel design was a three legged collapsible portable easel suitable for indoor as well as outdoor use. Studio easels, i.e., those used indoors, were usually free standing and offered the user a limited range of positions in which to place the workpiece.

Although those easels were widely used and accepted, they have limitations. For example, observation of those easels revealed that the adjustability of the workpiece position was generally inversely proportional to easel stability, and limitations in traditional easel design were particularly apparent in easels used with larger workpieces. Prior easel constructions did not include conveniently placed storage compartments within the easel construction itself which were accessible and usable without disturbing the position of the workpiece.

SUMMARY OF THE INVENTION

One object of the present invention is to provide an improved easel construction which overcomes the limitations and drawbacks of the prior art by utilizing a stable base and table surface to support and secure an easily adjustable workpiece holding and positioning frame.

Another object of the present invention is to provide an easily adjustable workpiece holding and positioning frame with a wide range of available positions to accommodate workpieces of widely various sizes and shapes.

Yet another object of the present invention is to provide storage compartments in the easel construction itself which are placed in a convenient position, from which and into which objects may be placed without disturbing the workpiece.

These and other objects and advantages are accomplished by the present invention which provides a table easel construction.

The table easel construction includes a frame for holding and positioning workpieces of various sizes and shapes. The frame is secured at a lower end to a table surface mounted on a base, and includes a vertical support at its upper end. The lower end portion of the frame is slideably secured to the table surface so that it can be moved to and fro and fastened down in numerous positions between the front and rear edges of the table surface, thereby enabling the angle of the workpiece relative to the table as well as the relative distance of the workpiece to the artist to be changed.

The vertical support is attached to the rear edge of the table surface and to the upper end of the holding and positioning frame to provide stability to the workpiece while facilitating adjustability of the frame.

Lower and upper clamps are slideably attached to the holding and positioning frame so that they are independently adjustable upwardly and downwardly along the holding and positioning means. The lower clamp is shaped so as to support the lower edge of the workpiece. The independent adjustability of the clamps enables the distance between them to be increased and decreased to accommodate workpieces of various sizes, and also facilitates adjustment of the distance between the lower edge of the workpiece and the table surface.

Storage compartments may be provided at the underside of the table surface in a manner which provides easy access and usage without interference with the workpiece on the frame.

BRIEF DESCRIPTION OF THE DRAWINGS

In the drawings:

FIG. 1 is a view in front elevation of one embodiment of the table easel of the present invention with a painting canvas mounted thereon shown in broken lines.

FIG. 2 is a view in side elevation of the table easel of FIG. 1.

FIG. 3 is a view in rear elevation of the table easel of FIG. 1.

FIG. 4 is a somewhat diagrammatic view in side elevation of a portion of the frame of the table easel of FIG. 1 adjusted to a different position.

DETAILED DESCRIPTION OF A PREFERRED EMBODIMENT

As shown in the drawings, a table easel 10 incorporating the principles of the present invention includes a floor-standing frame 12, a horizontal table top 14 secured across the upper end of the frame 12, a material storage compartment 16 secured to the frame 12 and to the table top 14, and an easel 18 secured to the table top 14. The easel 18 includes diagonally aligned rear support members 20 and 22 which are secured at the lower ends adjacent the left and right rear corners 24 and 26 of the table top 14. The easel 18 also includes a workpiece support member 28 having an upper end hinged to be pivotable with respect to the rear support members 20 and 22 by a hinge pin 30 which passes through upper flanges 32 and 34 of the supports 20 and 22 and through the uppermost portion of the member 28. Thus, the member 28 is free to swing and move in a front to back direction relative to the front of the table as shown in FIGS. 2 and 4.

A slide bracket 36 forms a hinge with the lower end of the workpiece support member 28 by virtue of a second hinge pin 38. The slide bracket 36 slides under a guide 40 formed of a raised strip of metal which is secured across the table top 14 at the center thereof. The bracket 36 includes a wing bolt 42 which is threaded through an opening in an upper plate 44 of the bracket 36 which forms in connection with the bottom of the bracket a sandwich through which the guide 40 passes. By tightening the wing bolt 42, the relative position of the support member 28 is fixed securely. By releasing the wing bolt 42, the bracket 36 is free to slide across most of the width of the table top 14 and can assume positions lying between the relatively slanted position shown in FIG. 2 and an almost vertical position as shown in FIG. 4.

A workpiece such as a painting canvas 46 is shown mounted on the easel portion 18 of the table easel 10 in FIGS. 1 and 2. The canvas 46 is held in vertical position by a lower support bracket 48 which includes an open end box-like portion slideably mounted over the support member 28. The portion 50 is provided with wing bolts 52 threaded through an opening in the side thereof to bear against the member 28 so as to lock the lower bracket 48 in the desired relative vertical location. The bracket 48 also includes a horizontally elongated L-shaped portion 54 fastened to the box-like portion 50 as by welding. The canvas 46 rests upon the lower lip 56 of the L-shaped portion 54.

An upper fastening bracket 58 is provided on the support member 28. The bracket 58 is formed in an open ended box-like construction and is mounted to slide up and down the member 28. The bracket 58 is provided with a locking wing bolt 60 and with securing clamps 62 and 64 which fit down over the canvas 46 to lock it in place. The table easel 10 is preferably formed of metal such as soft steel.

The storage container 16 may be open as shown in FIG. 1, with a plurality of shelves 66 and 68, or it may be fitted with drawers or a door as desired or required by the particular application.

It will be appreciated that the easel 10 of the present invention may be provided with other forms of bracing than the braces 20 and 22 as shown. Any supporting frame securely fastened to the top of a table which enables a workpiece such as the canvas 46 to be adjusted inwardly and outwardly (as by operation of the bracket 36 and the guide 40) and up and down (as by adjustment of the brackets 48 and 58) will work well to provide other suitable embodiments of the present invention.

To those skilled in the art to which this invention relates, many changes in construction and widely differing embodiments and applications of the invention will suggest themselves without departing from the spirit and scope of the invention. The disclosures and the description herein and purely illustrative and are not intended to be in any sense limiting.

I claim:

1. A table easel wherein the workpiece can be held in a multiplicity of positions above the table on which the easel is mounted, said table easel comprising:

vertically disposed workpiece holding and positioning means for engaging and holding a generally flat and rectangular workpiece above the table on which the easel is mounted;

vertical support means fastened to the rear edge of the table top and extending upwardly from it to an attachment location where the said workpiece holding and positioning means is attached;

a flat horizontal track fixed securely to the table at both the front and rear major edges of the table top and adjacently spaced above it, the horizontal surfaces of said track being positioned parallel to the upper surface of the table top and substantially perpendicular to its front and rear edge, and said track being spaced high enough above said table top to allow the adjustment bracket which is pivotally attached to the lower end of said holding and positioning means to move forwardly and rearwardly along said track;

said workpiece holding and positioning means including an adjustment bracket pivotally attached to the lower end of the workpiece holding and positioning means, being slightly wider than the horizontal track so that said adjustment bracket can slide freely forwardly and backwardly along the horizontal track when said adjustment bracket is loosened thereby allowing the artist to adjust the angle of the workpiece in relation to the table top;

said adjustment bracket including a wing nut which screws downwardly through the upper horizontal surface of said adjustment bracket that is parallel to the horizontal track and upper table top surface, which, when tightened, holds the bracket securely in place on the horizontal track thereby fastening the workpiece holding and positioning means securely in place, and which, when loosened, allows the adjustment bracket to slide forwardly and rearwardly along the horizontal track thereby allowing the artist to adjust the angle of the workpiece in relation to the table top;

said holding and positioning means including a top clamp comprising a hollow rectangular part enclosing the holding and positioning means and slightly larger than said holding and positioning means so that it can slide freely upwardly and downwardly, and a flat part attached to said rectangular piece on its outer side parallel to the major upper surface of the holding and positioning means;

said top clamp including a wing nut screwing horizontally through one of the narrow sides of the hollow rectangular part of said top clamp, which, when tightened holds the top clamp securely in place on the holding and positioning means and which, when loosened, allows the artist to slide the top clamp upwardly and downwardly along the holding and positioning means, thereby changing the distance between the top clamp and the bottom clamp to accommodate workpieces of various shapes and sizes as well as adjusting the distance between the table top and the workpiece;

said top clamp having a plurality of small sharp pins projecting from the lower edge of the flat piece attached to the front side of the rectangular piece which penetrate the workpiece while it is on the easel and which, in conjunction with the ledge or L-shaped part of the bottom clamp; hold the workpiece in place;

said holding and positioning means including a bottom clamp comprised of a hollow rectangular part identical to the hollow rectangular part of the top clamp, and an L-shaped part attached to said rectangular part on the outer side of the hollow rectangular part and parallel to the major upper surface of the holding and positioning means;

said L-shaped part having a ledge perpendicular the rectangular part along its lower edge that is deep enough for the workpiece to rest upon and wide enough to support the lower edge of the workpiece when the top and bottom clamps are positioned to fit it;

said bottom clamp including a wing nut screwing horizontally through one of the narrow sides of the hollow rectangular part of said bottom clamp, which, when tightened, holds the bottom clamp firmly in place and which, when loosened, allows the artist to slide the bottom clamp upwardly and downwardly along the holding and positioning means thereby allowing the distance between the bottom clamp and the top clamp to be changed to accommodate workpieces of various sizes and shapes as well as allowing the adjustment of the distance between the table top and the workpiece;

a table top with a flat surface perpendicular to said fixed vertical support means attached to its rear edge, having at least one storage compartment attached to its underside, having the said flat horizontal track attached to its front and rear edges, and being supported by a base; and a base on which the table top is securedly mounted.

* * * * *